US007374128B2

(12) United States Patent
Hendrix et al.

(10) Patent No.: US 7,374,128 B2
(45) Date of Patent: May 20, 2008

(54) MULTIPLE TOILET PAPER HOLDER AND DISPENSER

(76) Inventors: Roy D. Hendrix, 4350 S. Garnett Rd., Apt. #206, Tulsa, OK (US) 74146; Alexis Hendrix, 4350 S. Garnett Rd., Apt. #206, Tulsa, OK (US) 74146

( * ) Notice: Subject to any disclaimer, the term of this patent is extended or adjusted under 35 U.S.C. 154(b) by 25 days.

(21) Appl. No.: 11/486,570

(22) Filed: Jul. 14, 2006

(65) Prior Publication Data

US 2007/0023563 A1 Feb. 1, 2007

Related U.S. Application Data

(60) Provisional application No. 60/699,896, filed on Jul. 15, 2005.

(51) Int. Cl.
*B65H 49/00* (2006.01)

(52) U.S. Cl. ..... 242/560.3; 242/594.4; 242/594.5

(58) Field of Classification Search ..... 242/560, 242/560.2, 560.3, 561, 594, 594.1, 594.3, 242/594.4, 594.5, 594.6; D6/518, 519, 520, D6/523

See application file for complete search history.

(56) References Cited

U.S. PATENT DOCUMENTS 2,896,871 A * 7/1959 Woodruff ..... 242/560.3
3,101,181 A * 8/1963 Clelland et al. ..... 242/560.3
3,132,782 A * 5/1964 Coates, Jr. ..... 242/594.5
3,271,090 A * 9/1966 Smithers ..... 242/560
4,034,924 A * 7/1977 Carlisle ..... 242/560.3
4,098,469 A * 7/1978 McCarthy ..... 242/560.3
4,135,678 A * 1/1979 Williams ..... 242/560.3
D257,082 S * 9/1980 Williams ..... D6/519
5,570,938 A * 11/1996 Butler ..... 242/594.3
6,302,350 B1 * 10/2001 Burrell et al. ..... 242/560
D472,398 S * 4/2003 Sparkowski ..... D6/518
D478,737 S * 8/2003 Sparkowski ..... D6/518

* cited by examiner

*Primary Examiner*—William A Rivera
(74) *Attorney, Agent, or Firm*—Raymond M. Galasso; Galasso & Associates, LP

(57) ABSTRACT

A toilet paper dispenser that is configured to retain and subsequently dispense a plurality of toilet paper rolls. The toilet paper dispenser further includes a front wall, a rear wall and two side walls that are configured to create a container that is generally rectangular in shape having an interior volume. Contiguously mounted to the front wall proximate the upper portion of the container is a door hingedly mounted to allow access to the interior volume for loading of toilet paper rolls. An access flap is mounted generally beneath the door contiguous with the front wall and is hingedly mounted to provide access to the interior volume for retrieval of depleted toilet paper rolls. The access flap further includes a slot that is configured to dispense sheets of toilet paper from the adjacent toilet paper roll substantially disposed within the interior volume of the container.

16 Claims, 4 Drawing Sheets

MULTIPLE TOILET PAPER HOLDER AND DISPENSER

PRIORITY UNDER 35 U.S.C. §119(e) & 37 C.F.R. Ø1.78

This nonprovisional application claims priority based upon the following prior U.S. provisional patent application entitled: *Multiple holder for toilet paper recessed tray*, Application No. 60/699,896, filed Jul. 15, 2005, in the names of Roy D. Hendrix and Alexis Hendrix, which is hereby incorporated by reference for all purposes.

FIELD OF THE INVENTION

The present invention relates to a toilet paper holder and dispenser, more specifically but not by way of limitation, a toilet paper holder and dispenser that is designed to accommodate a multiple roles of toilet paper and facilitate the protection of the toilet paper rolls and the successional use hereof.

BACKGROUND

Good hygiene is a routine practice for most individuals and is practiced on a daily basis. Toilet paper is a routine part of practicing good hygiene. Toilet paper holders have been in use for years and are routinely located proximate a toilet for a user to access when required. Typically, a conventional toilet paper holder is comprised of a U-shaped bracket or dual post structure that is secured to the wall or cabinet with a spring-loaded telescoping member intermediate the opposing forks of the toilet paper holder. This typical installation is designed for rotatably supporting a single roll of toilet paper.

One problem with toilet paper holders is that the typical toilet paper holder can only secure one roll at a time. As the toilet paper holder is emptied an individual must have a refill roll available and change the roll frequently. If the roll is not filled for the next individual to make use of the restroom facilities it can create a difficult situation for that individual.

Another issue with typical toilet paper holders is that they leave the toilet paper roll exposed whereby the exposed toilet paper is easily accessible to children or pets who often proceed to unwind at least a portion of the toilet paper roll. This creates excessive waste and frustration for the individual required to clean up after the pet or child.

Accordingly, there is a need for a toilet paper dispenser that has the ability to store and subsequently dispense a plurality of toilet paper rolls and simultaneously conceal and protect the toilet paper rolls inhibiting any unwanted dispensing of the toilet paper roll contained therein.

SUMMARY OF THE INVENTION

It is the object of the present invention to provide a toilet paper dispenser that provides for storage, protection and subsequent dispensing of multiple toilet paper rolls.

It is a further object of the present invention to provide a toilet paper dispenser that stores the rolls in a concealed container to prevent unwanted disposal.

Yet another object of the present-invention is to provide a toilet paper holder and dispenser that stores and subsequently dispenses a plurality of toilet paper rolls that can be partially recessed into a wall proximate a toilet.

A further object of the present invention is to provide a toilet paper holder and dispenser that stores and subsequently dispenses a plurality of toilet paper rolls that is lightweight and inexpensive.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawing wherein:

DETAILED DESCRIPTION

Figure 1:
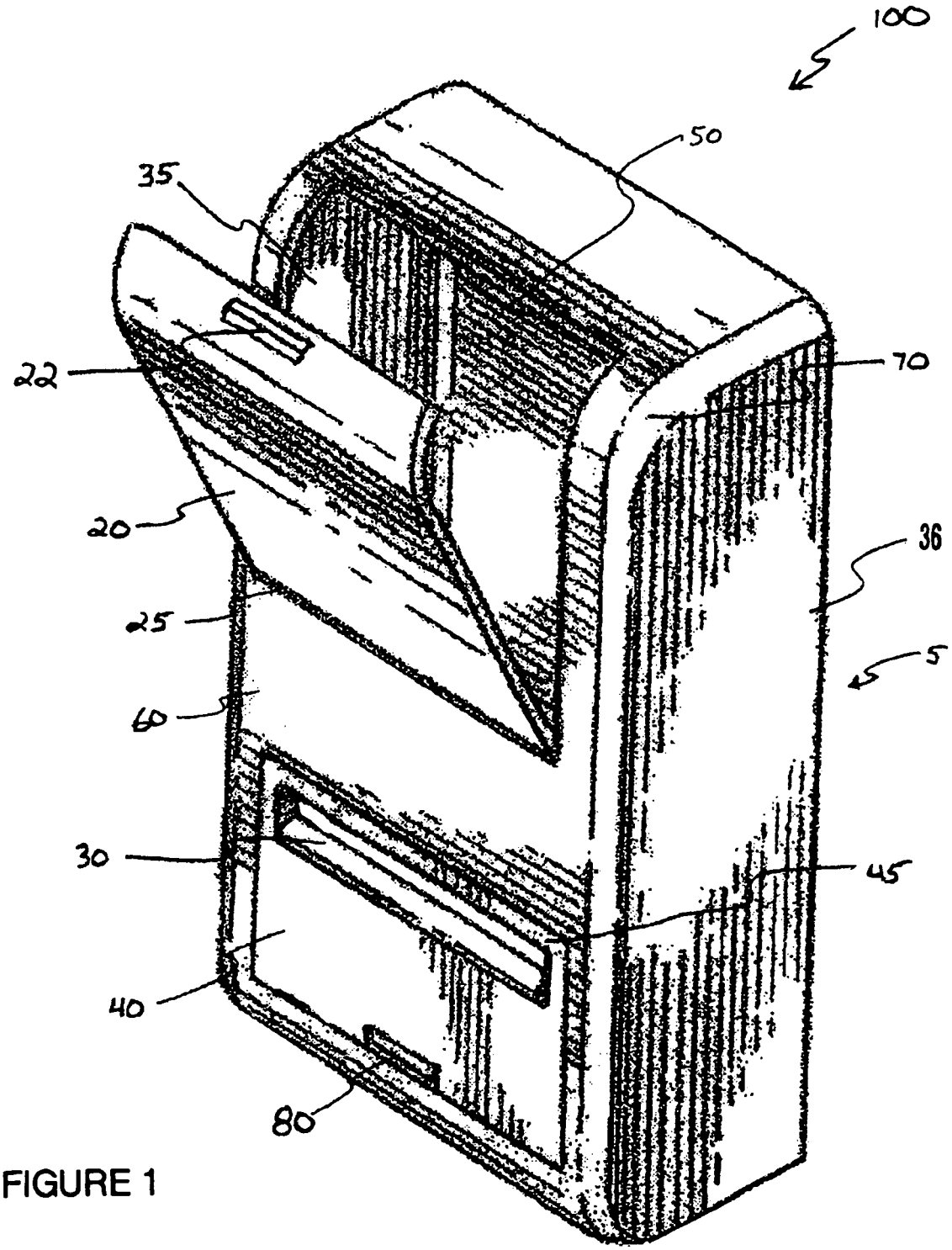
FIG. 1 is a perspective view of an embodiment of the present invention.
Figure 2:
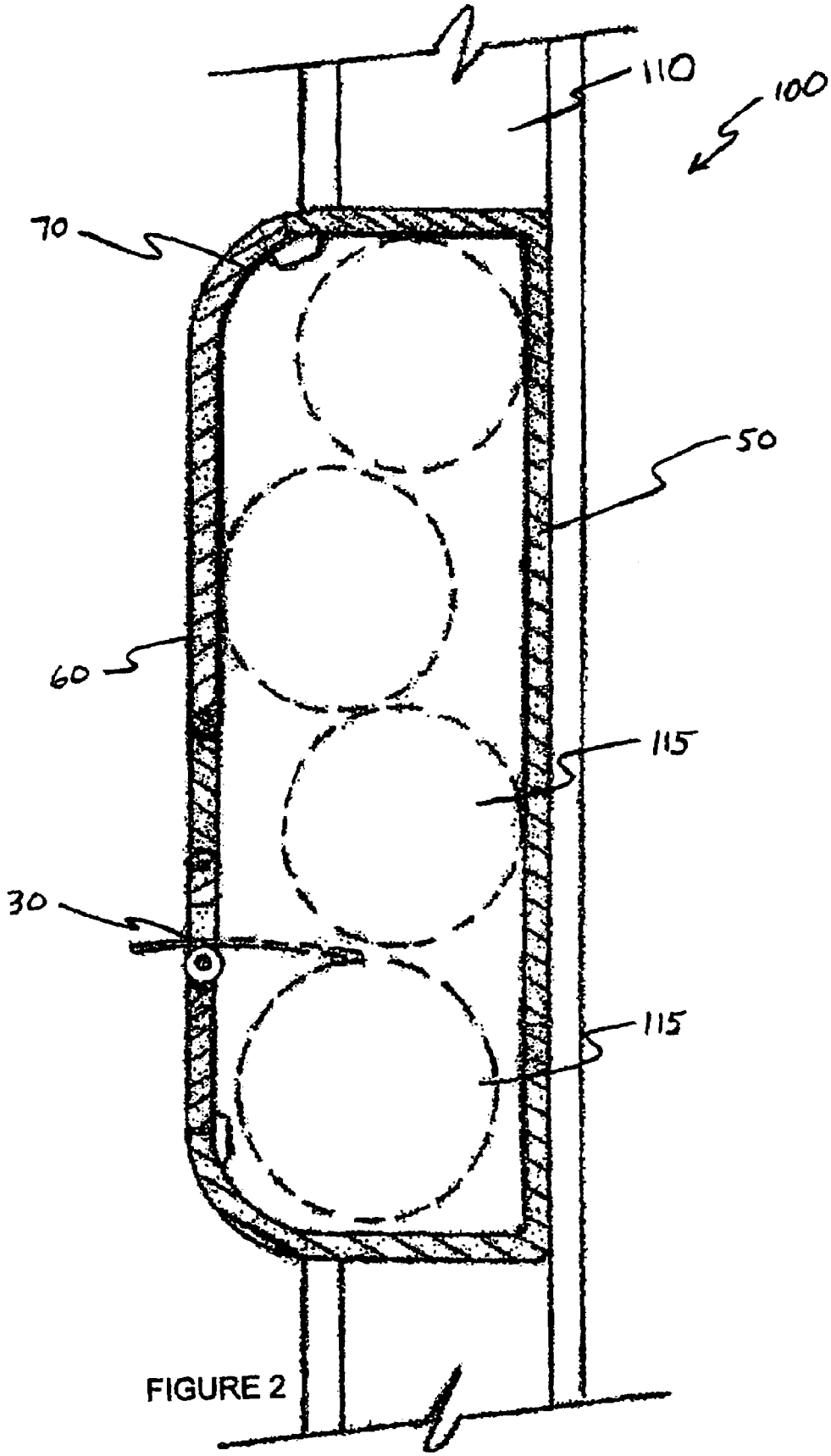
FIG. 2 is a cross sectional view of the embodiment of the present invention shown partially recessed into a wall.

Referring now to the drawings, wherein various elements depicted therein are not necessarily drawn to scale and wherein like elements and designated with like reference numerals throughout the views and figures, and in particular FIGS. 1 and 2, there is illustrated a preferred embodiment of toilet paper dispenser 100 constructed according to the principles of the present invention.

The toilet paper dispenser 100 comprises a container 5 that further includes side two walls 35 and 36, a rear wall 50 and a front wall 60. The container 5 is substantially hollow with an interior volume sufficient in size to accommodate multiple toilet paper rolls 115 (see FIG. 2). The front wall 60 further includes a door 20 hingedly mounted proximate the edge 25. Beneath the door 20 is a access flap 40 that has incorporated therein a slot 30.

The container 5 is manufactured of a suitable durable material such as plastic utilizing conventional manufacturing processes such as but not limited to injection molding. The container 5 is designed to be partially recessed into a standard household wall that is manufactured from wood studs and drywall. Those skilled in the art should recognize that although it is desired that the container 5 be mounted partially recessed into a wall, the container 5 could be mounted superposed to a wall and still achieve the desired functionality as described herein.

The side walls 35 and 36 are generally perpendicular and contiguous with the rear wall 50. The side walls 35 and 36 are rectangular in shape having an upper portion 70 that is generally arcuate in shape. Those skilled in the art will recognize that the upper portion 70 of the side walls 35 and 36 could be numerous different shapes other than the shape illustrated in the drawings submitted herewith. The container 5 has an interior volume to accommodate approximately four toilet paper rolls 115 as shown in particular in FIG. 2. It is further contemplated within the scope of the present invention that the container 5 could be manufactured in a plurality of different sizes in order to accommodate therein different amounts of toilet paper rolls 115 configured in different orientations. More specifically but not by way of limitation, the container 5 could be configured to have an interior volume to retain four toilet paper rolls 115 configured in two equivalent and generally parallel stacks. It is contemplated that the container 5 be available in a plurality of configuration with numerous different toilet paper roll 115 capacities and have the ability to be partially recessed into a conventional household wall intermediate to wall studs 110 that are approximately sixteen inches apart. Those skilled in the art will recognize that the container 5 could be utilized to retain as few as one toilet paper roll 115. Furthermore, those skilled in the art will recognize that the container could be manufactured in numerous different colors and designs without departing from the desired function as described herein. It should also be recognized by those skilled in the art that the container 5 could be manufactured from numerous different amounts of walls in order to create an interior volume.

The front wall 60 is mounted generally perpendicular to side walls 35 and 36 and is intermediate thereto. The front wall 60 is manufactured from a suitable durable and rigid material such as but not limited to plastic. Hingedly mounted to the front wall 60 is a door 20. The door 20 is hingedly mounted proximate the bottom edge 25 using a mechanical fastener such as but not limited to a piano type hinge.

The door 20 functions to provide access to the interior volume of the container 5 allowing a user to load into the toilet paper dispenser 100 the desired amount of toilet paper rolls 115. While the door 20 is shown in the drawings submitted herewith as being hingedly mounted to the front wall 60, it is further contemplated within the scope of the present invention that the door 20 could be mounted in a plurality of different manners. More specifically but not by way of limitation, the door 20 could be mounted on tracks whereby the door 20 would be rolled generally upwards and inward towards the container 5 permitting a user to access the interior volume of the container to stack the desired number of toilet paper rolls 115 therein (see FIGS. 3 and 4 described herein below).

The door 20 further includes an attachment mechanism 22 that functions to releasably secure the door 20 to the front wall 60 subsequent to loading of the toilet paper rolls 115 and maintain the door 20 in a closed position.

Beneath the door 20 is an access flap 40. The access flap 40 is mounted by suitable mechanical methods to the front wall 60. More specifically but not by way of limitation the access flap 40 could be mounted with a piano type hinge or track mounted allowing the access flap 40 to be rolled generally upward and inward towards the interior volume of the container 5. Disposed within the access flap 40 proximate the top portion 45 is a slot 30. The slot 30 is generally rectangular in shape and of suitable size to accommodate the passing therethrough sheets of toilet paper. A user will journal paper from the toilet paper roll 115 adjacent to the access flap 40 thereby functioning to allow a user to dispense the desired amount of toilet paper from the toilet paper roll 115 via the slot 30.

The access flap 40 is releasably secured to the front wall with a keeper 80. The keeper 80 functions to maintain the access flap 40 in a closed position while a user dispenses paper from the toilet paper roll 115 adjacent thereto. The keeper 80 is manufactured utilizing suitable mechanical methods.

It is further contemplated within the scope of the present invention that the container 5 further includes a plurality of retractable rotating pins internally mounted on the side walls 35 and 36 that are designed to releasably secure a toilet paper roll 115 placed thereon. Furthermore, it is also contemplated within the scope of the present invention that the container 5 further include a button that would function to release the empty toilet paper roll 115 from the retractable rotating pins engaged therewith subsequent to the depletion of the toilet paper roll 115 or when a user desires to remove the toilet paper roll 115 from the container 5.

Those skilled in the art will recognize that the toilet paper dispenser 100 could be adapted to hold a variety of different types of rolled paper products. More specifically but not by way of limitation, the container 5 could be adapted to retain and subsequently dispense a plurality of conventional paper towel rolls for use in numerous areas other than a bathroom.

Figure 3:
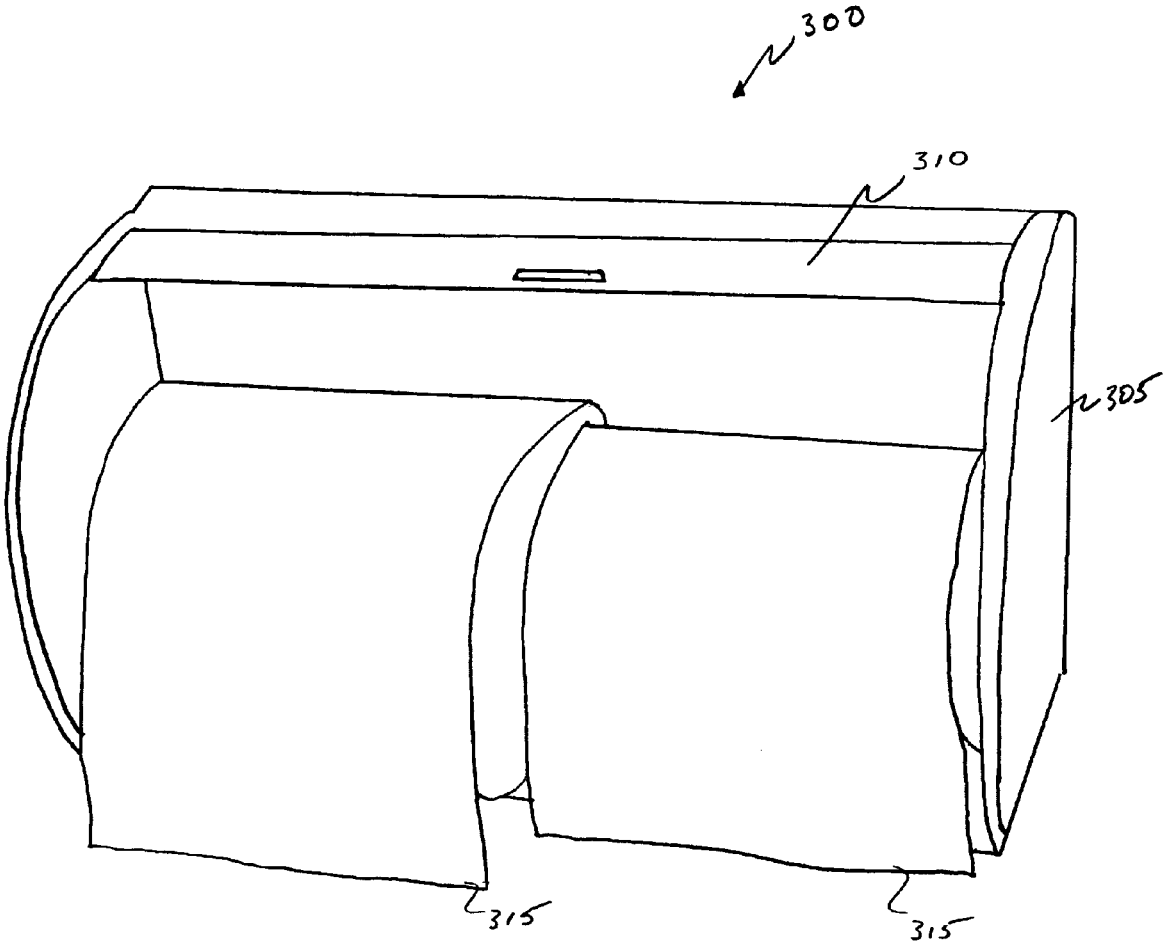
FIG. 3 is a perspective view of an alternative embodiment of the present invention.

Referring now to FIG. 3, there is illustrated an alternative embodiment of a toilet paper dispenser 300. As illustrated toilet paper dispenser 300 includes a body 305 configured to receive two toilet paper rolls 315 positioned side-by-side. A door 310 is movably connected to body 305 and can be opened and closed about toilet paper rolls 315. Door 310 is configured to be rolled generally upward and inward towards the interior of body 305 when in the open positioned, and it is rolled downward and away from the interior of body 305 when in the closed positioned (as similarly shown in FIG. 4).

Figure 4:
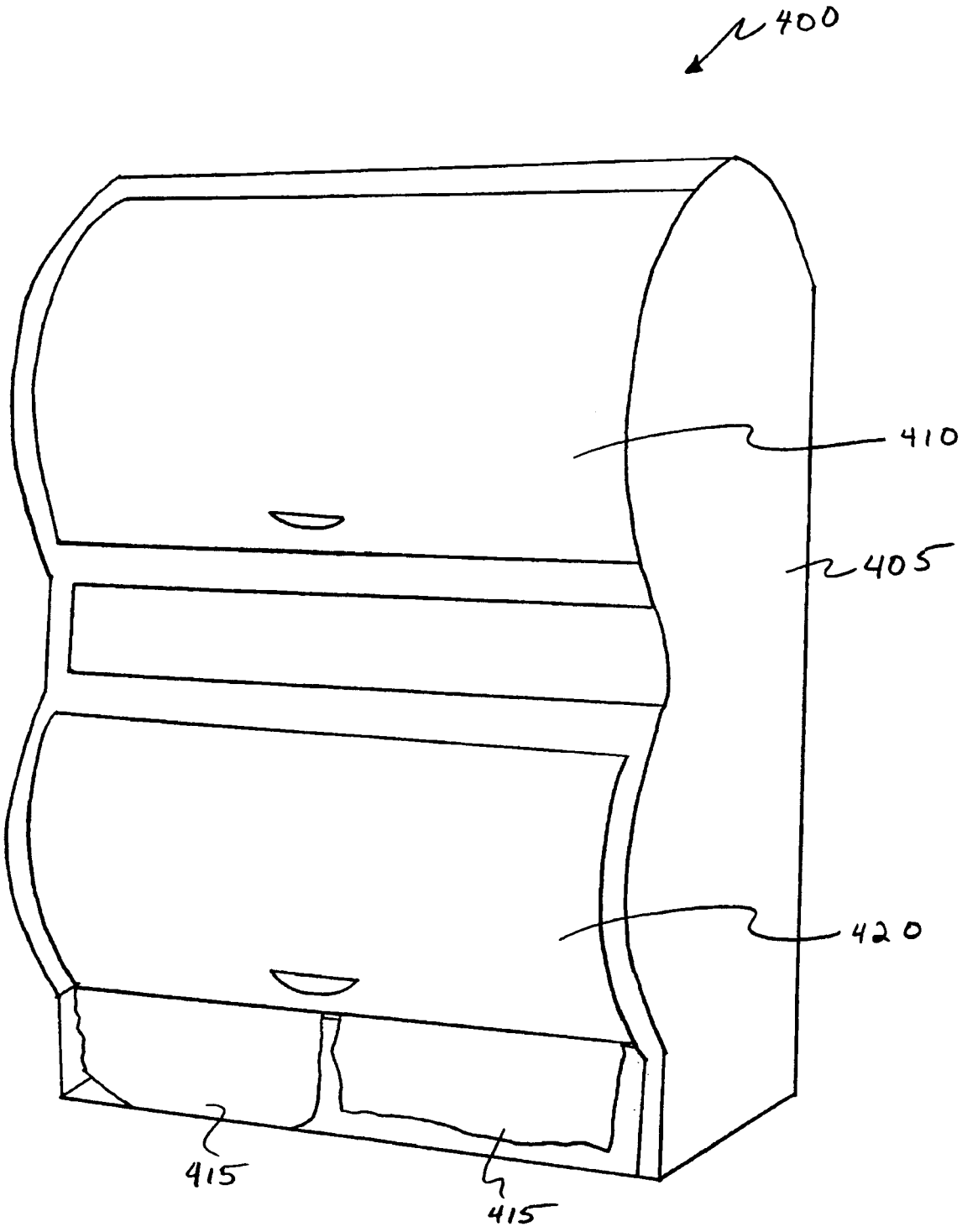
FIG. 4 is a perspective view of another alternative embodiment of the present invention.

Referring now to FIG. 4, there is illustrated an alternative embodiment of a toilet paper dispenser 400. As illustrated toilet paper dispenser 400 includes a body 405 configured to receive two sets of toilet paper rolls 415 positioned side-by-side with one set positioned above the other. A first set of toilet paper rolls is positioned behind 410 and the second set of toilet paper rolls is positioned behind door 420. Each of the doors 410 and 420 are movably connected to body 405 and can be opened and closed about the toilet paper rolls. Each of the doors 410 and 420 are configured to be rolled generally upward and inward towards the interior of body 405 when in the open positioned (as similarly shown in FIG. 3), and it is rolled downward and away from the interior of body 405 when in the closed positioned. In this embodiment, it is contemplated that the body 405 of toilet paper dispense 400 could be configured with a width to accommodate a single role behind each door 410 and 420.

Referring in particular to FIG. 1 submitted herewith, a description of the operation of the toilet paper dispenser 100 is as follows. In use, a user will mount the toilet paper dispenser 100 intermediate conventional wall studs 110 through an appropriate sized aperture in the adjacent wall material such that the container 5 is partially recessed into to wall. Subsequent to mounting the container 5 utilizing suitable mechanical methods, a user will engage the attachment mechanism 22 of the door 20 to allow access to the interior volume of the container 5. A user will then place the desired number of toilet paper rolls 115 into the container 5 and return the door 20 to its closed position. When needed the user will access the paper contained on the toilet paper roll 115 via the slot 30 mounted in the access flap 40. Once the toilet paper roll 115 adjacent to the access flap 40 has been depleted, the user will engage the keeper 80 to open the access flap 40 and remove the depleted toilet paper roll 115. As the depleted toilet paper roll 115 is removed, the adjacent toilet paper roll 115 transitions to replace the removed toilet paper roll 115. The user then threads the toilet paper through the slot 30 and returns the access flap 40 to a closed position. This process is repeated until all of the toilet paper rolls 115 disposed within the interior volume of the container 5 are depleted. The container 5 is then re-loaded with the desired number of toilet paper rolls 115 and the process is repeated.

In the preceding detailed description, reference has been made to the accompanying drawings that form a part hereof, and in which are shown by way of illustration specific embodiments in which the invention may be practiced. These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A toilet paper holder and dispenser comprising:

a container, said container having at least one wall configured to define an interior volume, said container having an interior volume being sufficient in size to accommodate a plurality of toilet paper rolls therein;

a first door configured to open and close about at least one of said plurality of toilet paper rolls; and a second door, said second door having a slot configured to dispense sheets from at least one of said plurality of rolls of toilet paper from said container.

2. The toilet paper dispenser as recited in claim 1, wherein said container is configured such that a first of said plurality of toilet paper rolls and a second of said plurality of said toilet paper rolls are positioned side-by-side.

3. The toilet paper dispenser as recited in claim 1, wherein said container is configured such that a first of said plurality of toilet paper rolls and a second of said plurality of said toilet paper rolls are positioned one above the other.

4. The toilet paper dispenser as recited in claim 1, wherein said second door is operable to provide access to said container for removal of depleted toilet paper roll and insertion of full toilet paper rolls.

5. The toilet paper dispenser recited in claim 4, wherein said container is mountable at least partially recessed into a wall.

6. A toilet paper dispenser comprising:

a container, said container having a plurality of walls, including two side walls and a rear wall, said container being configured with an interior volume being sufficient to receive a plurality of toilet paper rolls therein;

a first door movably connected to said container and operable between an open position and a closed position; and a second door movably connected to said container and operable between an open position and a closed position; said second door further including a slot; said slot configured to facilitate the dispensing of toilet paper from one of said plurality of toilet paper rolls.

7. The toilet paper dispenser as recited in claim 6, wherein said first door moves about at least one of said plurality of toilet paper rolls when moving between said open position and said closed position.

8. The toilet paper dispenser recited in claim 7, wherein said second door moves about at least a second of said plurality of toilet paper rolls when moving between said open position and said closed position.

9. The toilet paper dispenser as recited in claim 6, wherein said container is configured to accommodate therein a plurality of toilet paper rolls configured in adjacent and approximately equivalent stacks.

10. The toilet paper dispenser as recited in claim 9, wherein said container is to be mountable at least partially recessed into a wall.

11. A toilet paper dispenser configured to retain and dispense four toilet paper rolls comprising:

a container, said container having two side walls, a rear wall, and a front wall configured to define an interior volume, said container having an upper portion that is generally arcuate in shape, said container being generally rectangular in shape and having an interior volume being sufficient in size to accommodate a plurality of toilet paper rolls therein;

a first door and a second door, said first door being mounted proximate the upper portion of said container and further being contiguous with said front wall, said first door having a first and second position, said first door configured to access the interior volume of said container for allowing the installation of four toilet paper rolls therein, said second door being mounted proximate the lower portion of said container generally beneath said first door and further being contiguous with said front wall, said second door having a first and second position, said second door accessing the interior volume of said container to remove at least one of said plurality of toilet paper rolls; and a slot, said slot being mounted in said second door, said slot being configured have a sheet of toilet paper journaled therethrough from an adjacent toilet paper roll substantially disposed within the interior volume of said container.

12. The toilet paper dispenser as recited in claim 11, wherein said container is configured to retain the four toilet paper rolls in generally planar manner.

13. The toilet paper dispenser as recited in claim 12, wherein said container is mounted adjacent a conventional wall, said container further being partially recessed into the conventional wall.

14. The toilet paper dispenser as recited in claim 13, wherein the container is manufactured from plastic.

15. The toilet paper dispenser as recited in claim 14, wherein said first door and said second door further include an attachment mechanism to releasably secure said first door and said second door to said front wall in their first position.

16. The toilet paper dispenser recited in claim 11, wherein said container is configured to retain the four toilet paper rolls in a generally planar manner and wherein the toilet paper rolls are configured in adjacent and approximately equivalent stacks.

* * * * *